US007513202B2

(12) United States Patent
Graf et al.

(10) Patent No.: US 7,513,202 B2
(45) Date of Patent: Apr. 7, 2009

(54) STITCHING SYSTEM AND METHOD

(75) Inventors: James E. Graf, Littleton, CO (US); Dale A. Zoetewey, Denver, CO (US); Joseph A. Keating, Broomfield, CO (US); Howard A. Roepnack, Arvada, CO (US)

(73) Assignee: Melco Embroidery System, Denver, CO (US)

( * ) Notice: Subject to any disclaimer, the term of this patent is extended or adjusted under 35 U.S.C. 154(b) by 78 days.

(21) Appl. No.: 11/531,178

(22) Filed: Sep. 12, 2006

(65) Prior Publication Data

US 2007/0084389 A1 Apr. 19, 2007

Related U.S. Application Data

(60) Provisional application No. 60/716,632, filed on Sep. 13, 2005.

(51) Int. Cl.
*D05B 65/00* (2006.01)
*D05B 73/00* (2006.01)

(52) U.S. Cl. ..... 112/285

(58) Field of Classification Search ..... 112/285, 112/291, 296, 297, 293, 294, 475.09, 475.01, 112/475
See application file for complete search history.

(56) References Cited

U.S. PATENT DOCUMENTS 891,138 A * 6/1908 Bishop ..... 112/260
1,263,088 A * 4/1918 McNeil ..... 112/260
2,628,580 A 2/1953 Willis
3,386,402 A 6/1968 Ross
3,557,727 A * 1/1971 Heimann ..... 112/470.09
3,650,231 A * 3/1972 Tinari et al. ..... 112/260
3,875,877 A * 4/1975 Fox ..... 112/63
4,098,209 A 7/1978 Schopf
4,241,681 A * 12/1980 Porter ..... 112/322
4,879,960 A 11/1989 Prais
5,009,177 A * 4/1991 Sato et al. ..... 112/292
5,125,351 A 6/1992 Prais
5,417,173 A * 5/1995 Mitsuji ..... 112/475.01
5,762,014 A * 6/1998 JeanBlanc ..... 112/227
6,062,152 A * 5/2000 Yu et al. ..... 112/291
6,694,903 B1 * 2/2004 Chen ..... 112/298

* cited by examiner

*Primary Examiner*—Ismael Izaguirre
(74) *Attorney, Agent, or Firm*—Cooley Godward Kronish LLP

(57) ABSTRACT

A system, apparatus and method for stitching are described. One embodiment includes a sewing head including a needle; an arm assembly that is disposed relative to the sewing head so as to allow a garment to be placed between the sewing head and the arm assembly; and a non-planer needle plate coupled to the arm assembly that includes an aperture that is disposed so as to allow the needle to project through the aperture after the needle has moved through the garment.

12 Claims, 9 Drawing Sheets

STITCHING SYSTEM AND METHOD

PRIORITY

The present application claims priority from to commonly owned and assigned application No. 60/716,632, entitled Stitching System and Method, filed on Sep. 13, 2005, which is incorporated herein by reference.

FIELD OF THE INVENTION

The present invention relates to systems and methods for stitching. In particular, but not by way of limitation, the present invention relates to mechanized systems and methods for stitching.

BACKGROUND OF THE INVENTION

The stitching of patterns on fabrics using computer controlled sewing machines has become a standard practice in the industry. Fabrics that can be embroidered assume a variety of shapes and sizes. Popular shapes frequently embroidered are curved shapes that are often in the form of a cap (e.g., a baseball cap), shirt sleeves, pockets and pant legs where the fabric for embroidering includes the tubular or cylindrical-shape.

It is common to embroider tubular shaped objects (e.g., caps) with emblems, logos, letters and the like. Present embroidery equipment, however, is not particularly well-suited for providing embroidery along substantial portions of tubular or curved shaped objects. Accordingly, a system and method are needed to address the shortfalls of present technology and to provide other new and innovative features.

SUMMARY OF THE INVENTION

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

In some embodiments, the invention may be characterized as a stitching machine that includes a sewing head with a needle, an arm assembly disposed relative to the sewing head so as to allow a garment to be placed between the sewing head and the arm assembly and a non-planer needle plate coupled to the arm assembly. The non-planer needle plate in these embodiments includes an aperture that is disposed so as to allow the needle to project through the aperture after the needle has moved through the garment.

In several variations of these embodiments, a trimmer assembly is coupled to the arm assembly and the trimmer assembly includes a blade configured to trim thread while moving along an axis of the arm assembly. In many embodiments, the blade is configured to move along an axis of the arm assembly without substantial movement in a radial direction.

In another embodiment, the invention may be characterized as a trimmer assembly for a stitching machine comprising a trimmer housing adapted so as to couple with the stitching machine, a knife configured to slide within the trimmer housing along a single axis and a selector arm slideably coupled to the trimmer housing so as to be capable of sliding along a length of the trimmer housing. The selector arm in this embodiment includes one end with a hook portion that is configured to pull thread to the knife so as to trim the thread.

In yet another embodiment, the invention may be characterized as a knife for trimming thread comprising a planer portion including a slot that is configured to allow the planer portion to slide along a retainer pin and a blade portion coupled to the planer portion, wherein the blade portion is adapted so as to trim thread when the planer portion is moving along a single axis. In variations of this embodiment, the blade portion includes two tangs that are relatively disposed so as to allow thread to be trimmed when the thread is interposed between the two tangs. As previously stated, the above-described embodiments and implementations are for illustration purposes only. Numerous other embodiments, implementations, and details of the invention are easily recognized by those of skill in the art from the following descriptions and claims.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

Figure 1:
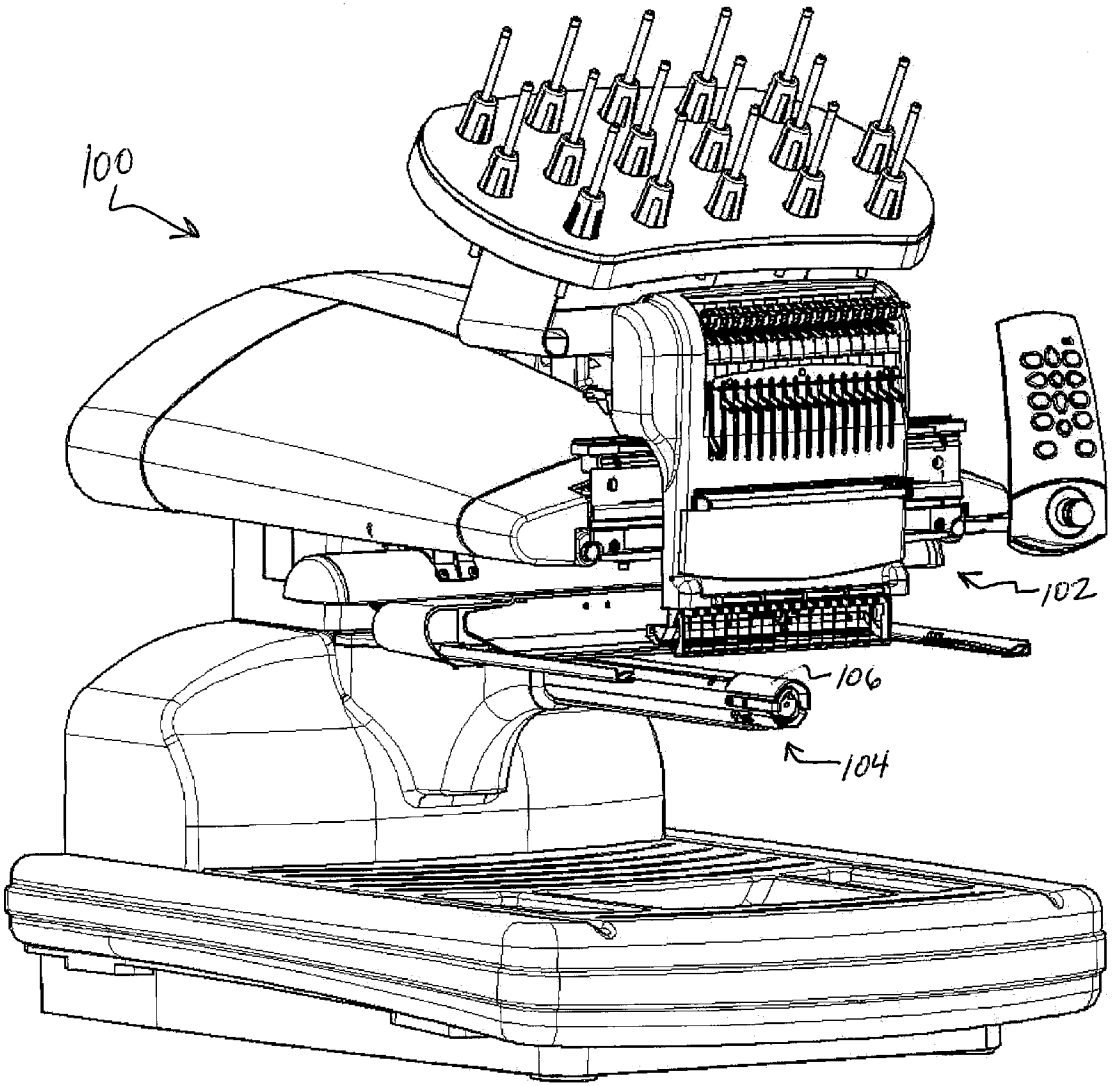
FIG. 1 is a perspective view of a stitching machine in accordance with the exemplary embodiment.

Referring now to the drawings, an exemplary embodiment is shown which depicts various aspects of the present invention. Shown in FIG. 1, is a perspective view of a stitching machine 100 in accordance with the exemplary embodiment. Shown is a head portion 102 positioned above a lower arm assembly 104. As depicted in FIG. 1, the lower arm assembly 104 includes a non-planer needle plate 106, which in this embodiment includes a curved (e.g., cylindrical-shaped) outer surface.

Advantageously, the curved surface of the needle plate accommodates garments with a tubular topology so as to allow a point of the garment that is being penetrated by a needle to rest against the needle plate 106. This is in contrast with prior art stitching machines that either must deform a tubular garment to conform to a planer needle plate or leave a gap between the garment and the planer needle plate.

Figure 2:
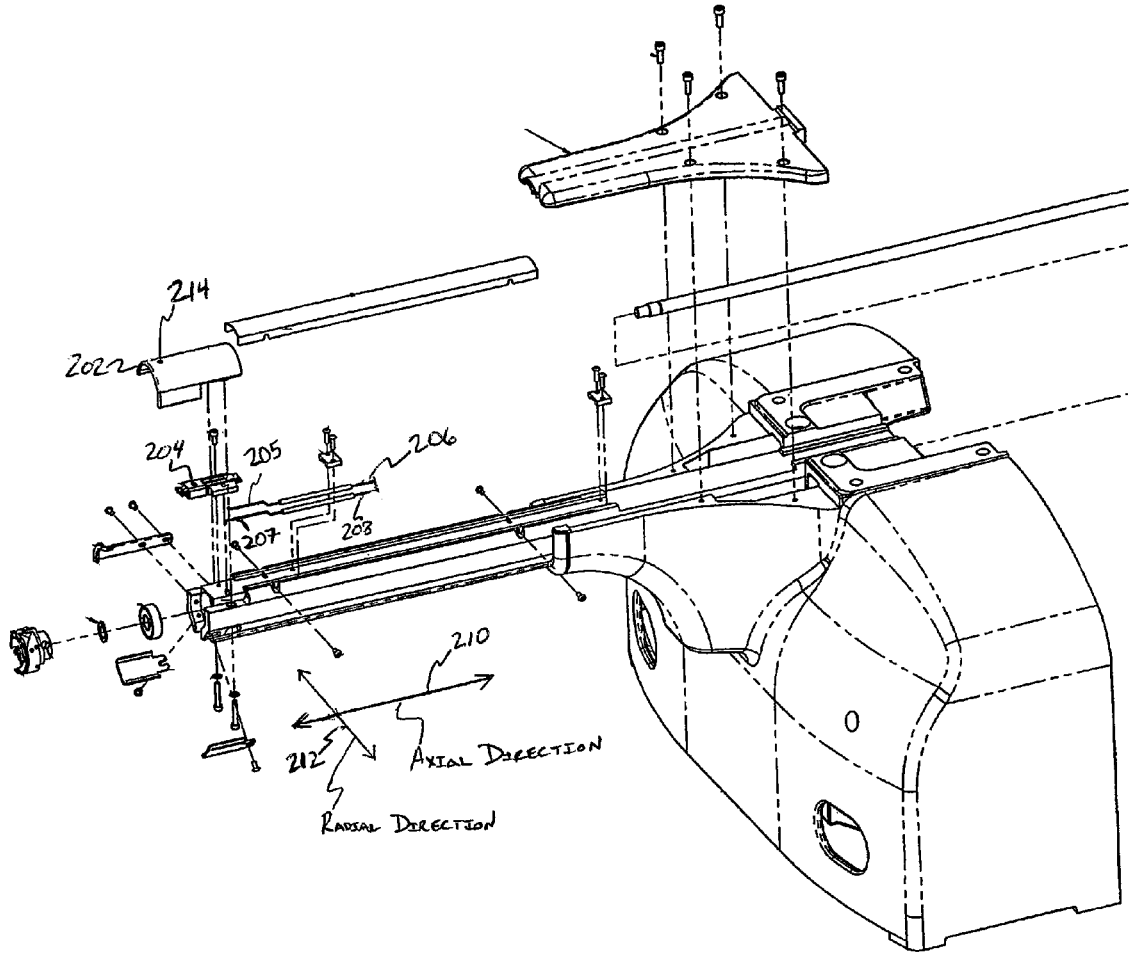
FIG. 2 a perspective front-view of the lower arm assembly depicted in FIG. 1 in a disassembled form.

Referring next to FIG. 2, shown is a perspective front-view of the lower arm assembly 200 in a disassembled form. As depicted in this embodiment, the lower arm assembly 200 includes among other components, a non-planer needle plate 202, a trimmer assembly 204 that couples to a push-pull cable 206 via a push rod 205 for a knife of the trimmer assembly 204 and a push cable 208 that couples to a selector of the trimmer assembly 204 via a push rod 207.

Also shown are an axial reference 210 (depicting an axial direction) and a radial reference 212 (depicting a radial direction perpendicular to the axial direction) relative to the arm assembly 200. As discussed further herein, a knife of the trimmer assembly 204 in several embodiments is capable of trimming a thread passing through the aperture 214 of the needle plate 202 while translating along the axial direction 210 (e.g., without substantial radial translation). In this way, the amount of space occupied by the trimmer assembly 204 is substantially reduced; thus allowing the needle plate 202 to be sized and configured to curve around the trimmer assembly 204 in a non-planer manner.

Figure 3:
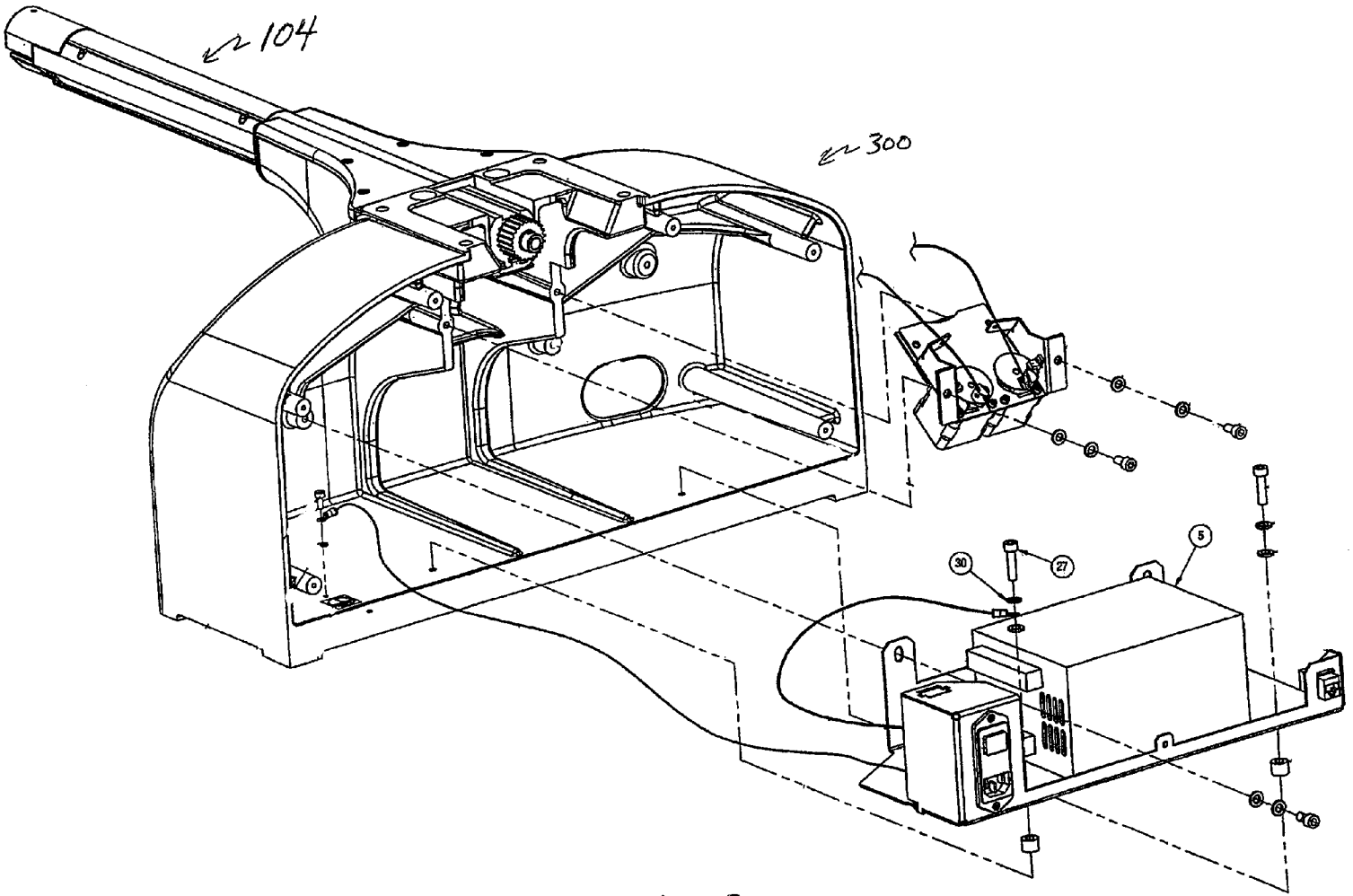
FIG. 3 a perspective rear-view of the lower arm assembly and a portion of the stitching machine depicted in FIG. 1.

Referring to FIG. 3, shown is a perspective rear-view of the lower arm assembly 104 and a rear portion of the body 300 of the stitching machine 100. As depicted, the lower arm assembly 104 in the exemplary embodiment protrudes from the body 300 of the stitching machine in a substantially perpendicular fashion.

Figure 4A:
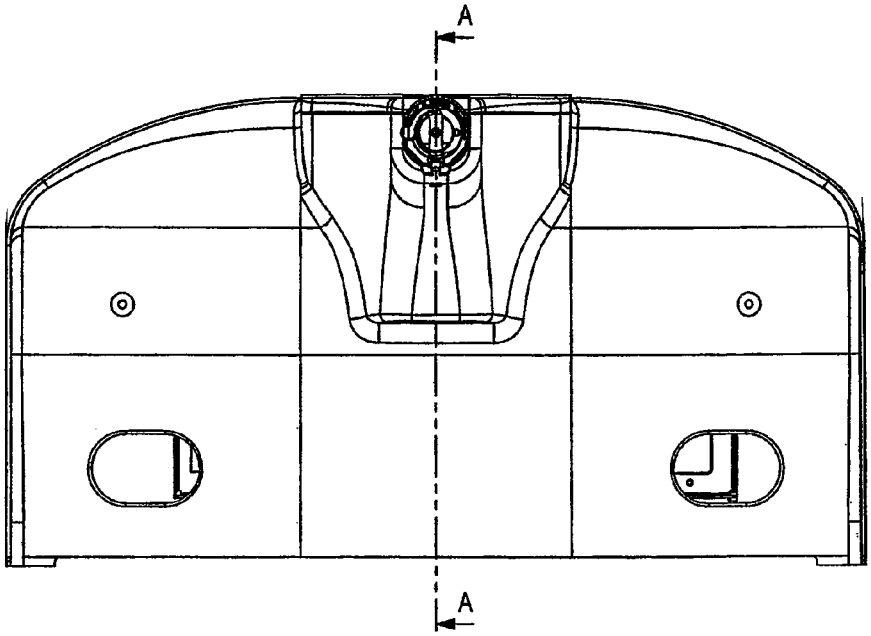
FIGS. 4A and 4B are a front view of the lower arm assembly and a side view of the lower arm assembly respectively.
Figure 4B:
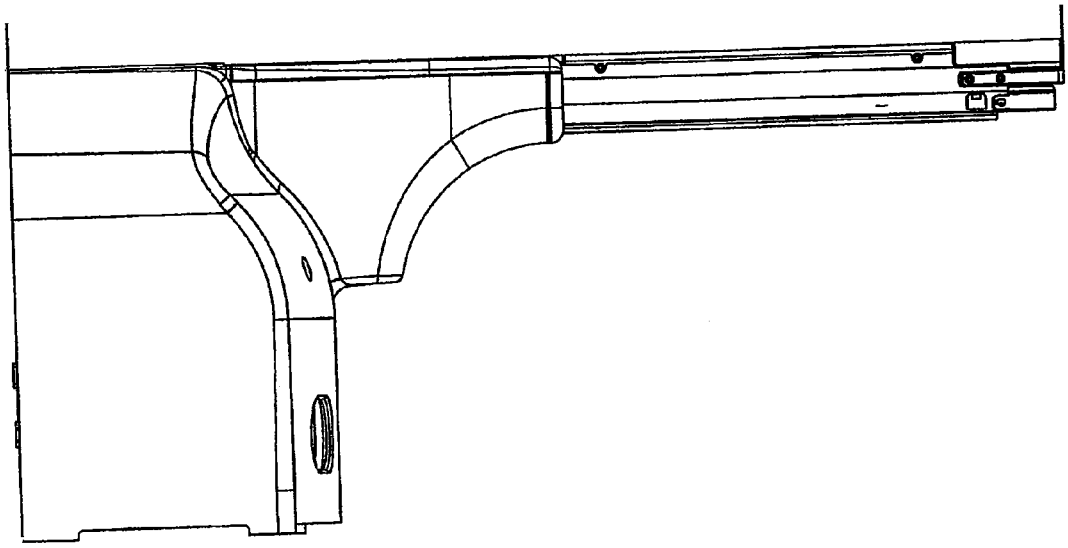
Figure 5A:
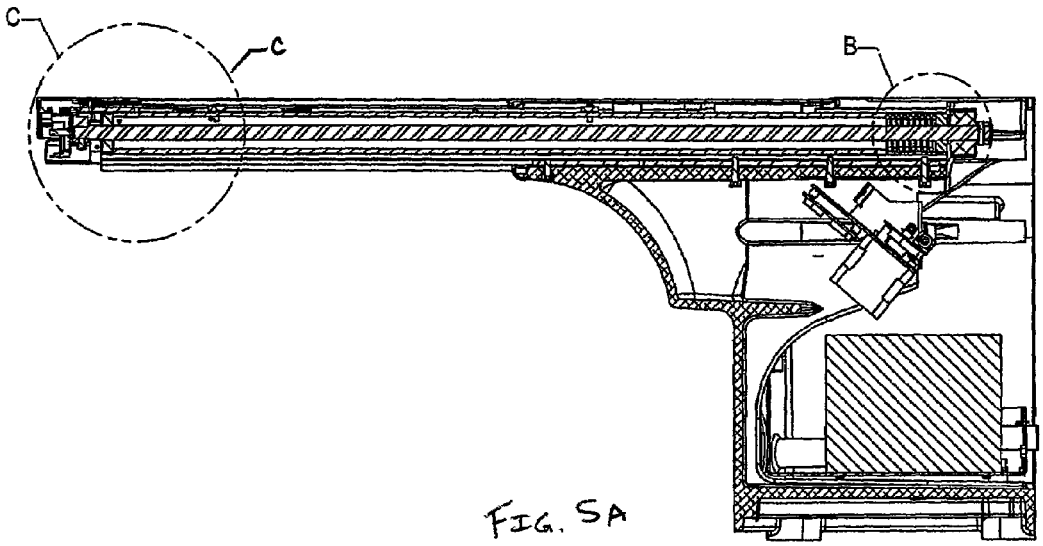
FIG. 5A is a cut-away view of the lower arm assembly along line A-A of FIG. 4A.
Figure 5B:
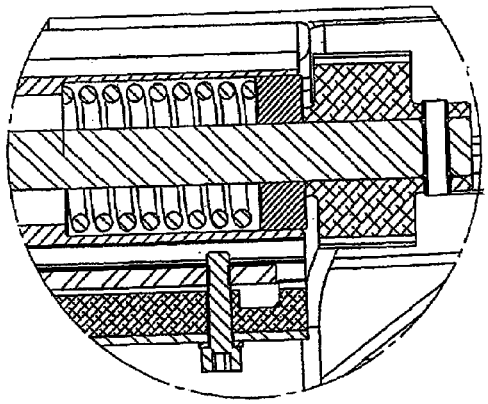
FIG. 5B depicts an exploded-detail view of a distal end of the lower arm assembly identified as area B in FIG. 5A.
Figure 5C:
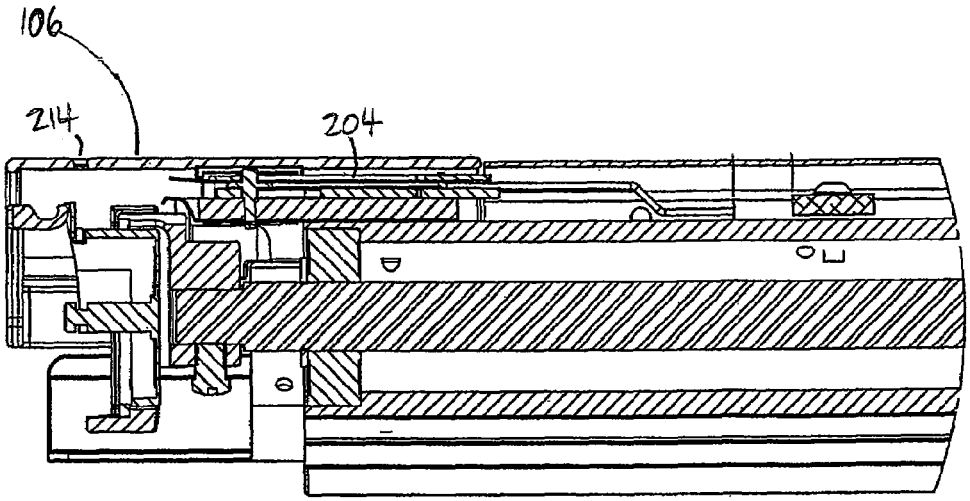
FIG. 5C shows an exploded and detailed view of a proximate end of the lower arm assembly identified as area C in FIG. 5A.
Figure 6B:
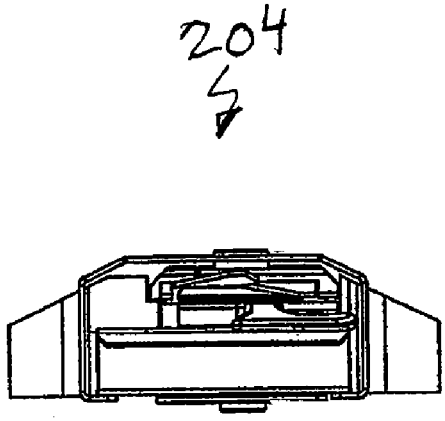
FIGS. 6A, 6B, 6C and 6D are respective, front, side and top views of the trimmer assembly depicted in FIG. 2.
Figure 6A:
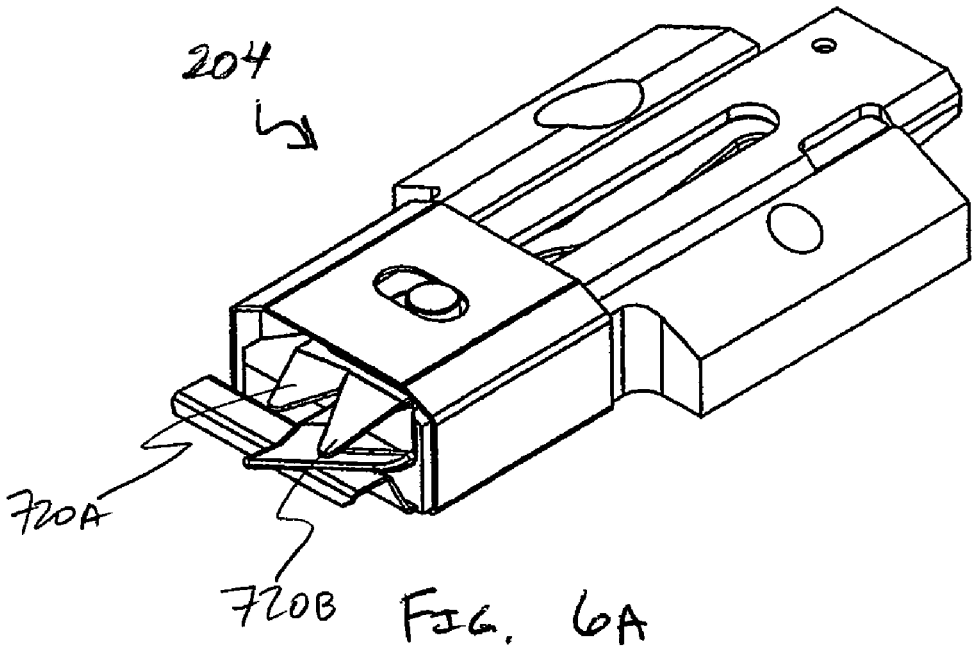
Figure 6C:
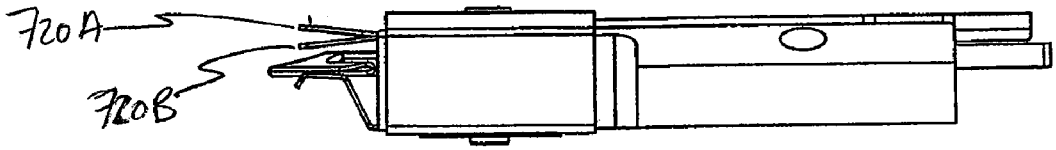
Figure 6D:
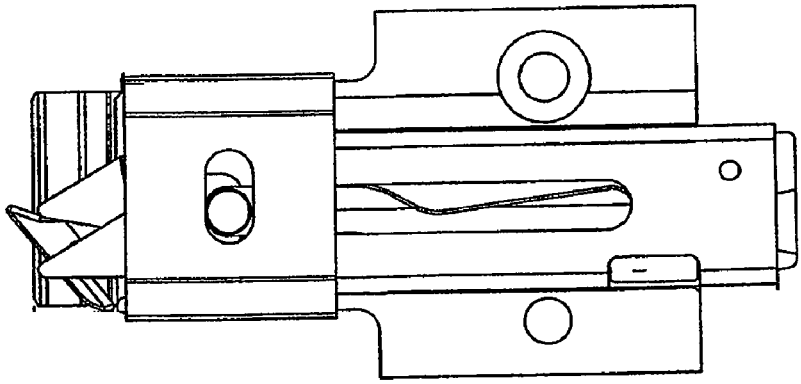

Referring to FIGS. 4A and 4B, shown are a front view of the lower arm assembly 104 and a side view of the lower arm assembly 104 respectively. In FIG. 5A, shown is a cut-away view of the lower arm assembly along line A-A of FIG. 4A. FIG. 5B depicts an exploded and detailed view of a proximate end of the lower arm assembly 104 identified as area B in FIG. 5A, and FIG. 5C shows an exploded detailed view of a distal end of the lower arm assembly 104 identified as area C in FIG. 5A.

Referring next to FIGS. 6A, 6B, 6C and 6D, shown are perspective, front, side and top views of the trimmer assembly 204 depicted in FIG. 2. Details of the trimmer assembly 204 are shown in FIG. 7, which shows a trimmer housing 700, a spring presser 702, a knife retainer pin 704, a selector 706, a knife 708, a knife carrier 710 and a knife hold down 712.

As depicted, the knife 708 in the exemplary embodiment includes a planer portion 714 that includes a slot 716 to accommodate the knife retainer pin 704. In addition, the knife 708 includes a blade portion 718 that includes a first and second tangs 720A, 720B that are configured to trim thread when thread is interposed between the two tangs 720A, 720B. In particular, the knife 708 in the exemplary embodiment is capable of trimming thread while moving solely in the axial direction shown in FIG. 7. As shown, the knife carrier 710 includes an aperture 722 to accommodate the push rod 205 that couples with the push-pull cable 206 (shown in FIG. 2) for the knife 708. The push rod 205 in this embodiment enables actuation of the knife 708 along the axial direction.

Referring again to FIG. 6C, the tangs 720A, 720B in one embodiment are relatively disposed so as to occupy a non-planer region (i.e., one tang is positioned lower than the other tang). In some embodiments, an inside edge of one or both tangs 720A, 720B is intentionally roughened so as to facilitate trimming of the thread.

Figure 7:
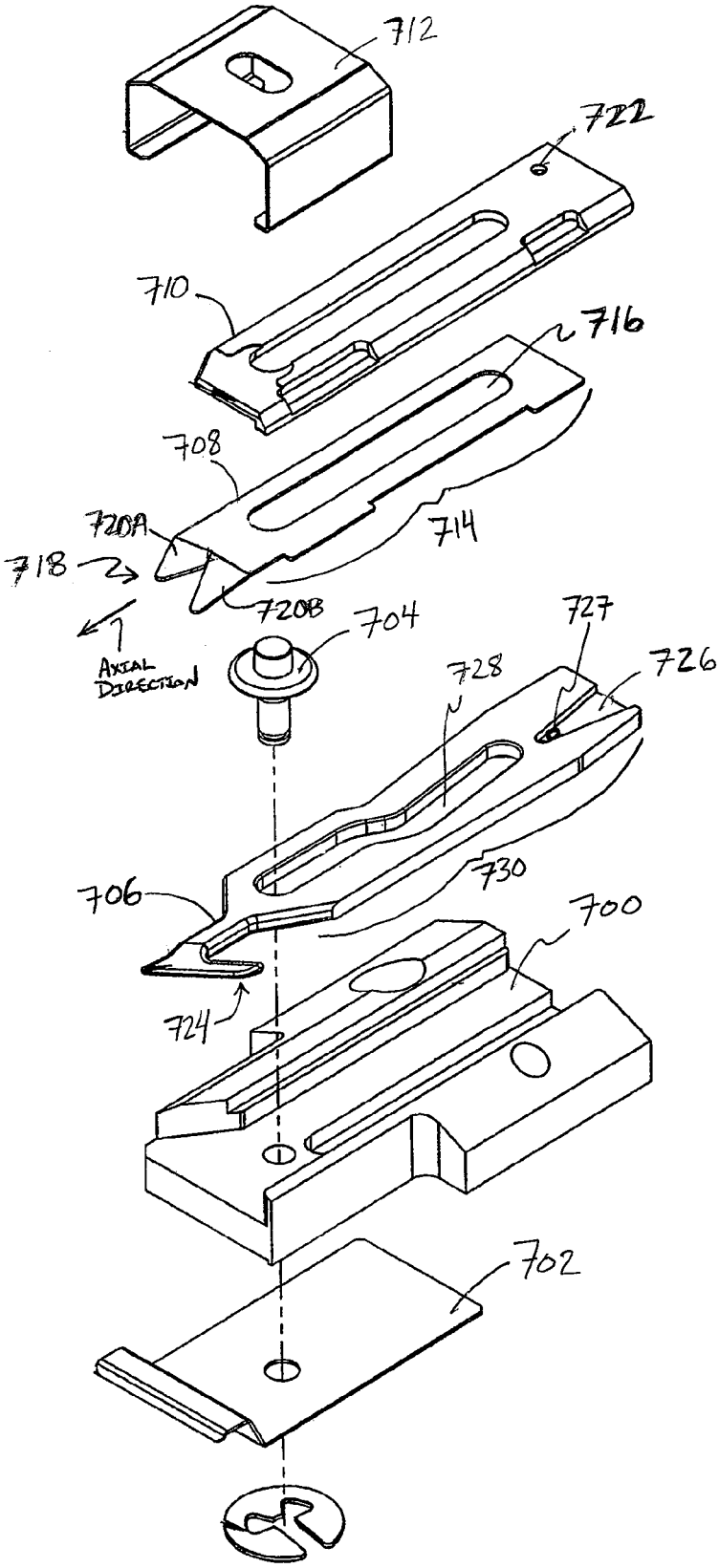
FIG. 7 is a detailed view of the trimmer assembly depicted in FIGS. 2 and 6.

As shown in FIG. 7, the selector 706 includes a hook 724 at a distal portion and a push rod coupling 726 and an aperture 727, which accommodates the push rod 207 for the selector 706, at a proximate portion. In addition, a slot 728 in a planer region 730 of the selector 706 is configured to accommodate the knife retainer pin 704, and in addition, the slot 728 is shaped so that when the selector 706 is pushed by the push rod 207 in an axial direction opposite its proximate end, the selector 706 moves in a radial-outward direction so as to allow the hook end 724 of the selector 706 to move around the thread and then to move back in a radial-inward direction to capture the thread. Then the selector 706 is moved in an axial direction inward to place tension on the thread so that the knife 708 may efficiently trim the thread.

Referring again to FIG. 5B, the trimmer assembly 204 is shown positioned within the distal end of the lower arm assembly 104. As shown the trimmer assembly 204 is in close proximity to the non-planer needle plate 106 so that there is very little distance between the blade of the knife 708 when extended and the inner portion of the aperture 214 of the needle plate 106. In this way, a tail of trimmed thread is short (which means less follow-up trimming by hand) and the thread length to the bobbin is relatively long allowing for easy handling.

As a consequence, the present invention provides several advantages over the prior art. Those skilled in the art, however, can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention.

What is claimed is:

1. A stitching machine comprising:

a sewing head, the sewing head including a needle;

an arm assembly, wherein the arm assembly is disposed relative to the sewing head so as to allow a garment to be placed between the sewing head and the arm assembly;

a non-planer needle plate coupled to the arm assembly, wherein the non-planer needle plate includes an aperture that is disposed so as to allow the needle to project through the aperture after the needle has moved through the garment; and a trimmer assembly coupled to the arm assembly, the trimmer assembly including a blade comprising two non-planer tangs, the blade configured to trim thread while moving along an axis of the arm assembly.

2. The stitching machine of claim 1, wherein the blade is configured to trim the thread while moving along an axis of the arm assembly without substantial movement in a radial direction.

3. The stitching machine of claim of claim 1, wherein the trimmer assembly includes a selector arm, wherein the selector arm is configured to move both along the axis of the arm assembly and a radial direction of the arm assembly so as to be capable of moving around the thread, selecting the thread and pulling the thread along the axis toward the blade.

4. The stitching machine of claim 1, wherein the aperture of the non-planer needle plate is within a part of the non-planer needle plate that includes a curved surface so as to enable a curved garment to be placed over the aperture while contacting substantially the entire curved surface.

5. A trimmer assembly for a stitching machine comprising:

a trimmer housing adapted so as to couple with the stitching machine;

a knife including two tangs, the knife configured to slide within the trimmer housing along a substantially-single axis; and a selector arm slideably coupled to the trimmer housing so as to be capable of sliding along a length of the trimmer housing, and wherein the selector arm includes one end with a hook portion configured to pull thread to the knife so as to trim the thread.

6. The trimmer assembly of claim 5, wherein the two tangs are non-planer.

7. The trimmer assembly of claim 5, wherein the selector arm is configured to move both along the substantially-single axis and a radial direction of the arm assembly so as to be capable of moving around the thread, selecting the thread and pulling the thread along the substantially-single axis toward the blade.

8. The trimmer assembly of claim 5, wherein the knife and the selector arm include respective slots, and wherein the knife and the selector arm are relatively disposed so that the respective slots of the knife and the selector arm are capable of sliding along respective portions of a knife-retainer pin.

9. A knife for trimming thread comprising;

a planer portion including a slot, wherein the slot is configured to allow the planer portion to slide along a retainer pin; and a blade portion coupled to the planer portion, the blade portion including two tangs, wherein the tangs are relatively disposed so as to allow thread to be trimmed when the thread is interposed between the two tangs, and wherein the blade portion is adapted so as to trim thread when the planer portion is moving along a substantially-single axis.

10. The knife of claim 9, wherein the tangs are disposed so as to be non-planer.

11. The knife of claim 9, wherein an inside edge of at least one of the tangs is roughened so as to facilitate trimming of the thread.

12. The knife of claim 9, wherein the blade portion is integrally coupled to the planer portion.

* * * * *